United States Patent [19]

Gloor

[11] Patent Number: 5,025,851

[45] Date of Patent: Jun. 25, 1991

[54] APPARATUS FOR CASTING THIN TAPES

[75] Inventor: Hans Gloor, Umiken, Switzerland

[73] Assignee: Concast Standard AG, Zurich, Switzerland

[21] Appl. No.: 490,560

[22] PCT Filed: Jul. 4, 1989

[86] PCT No.: PCT/CH89/00128

§ 371 Date: Mar. 16, 1990

§ 102(e) Date: Mar. 16, 1990

[87] PCT Pub. No.: WO90/00946

PCT Pub. Date: Feb. 8, 1990

[30] Foreign Application Priority Data

Jul. 20, 1988 [CH] Switzerland ..... 2776/88

[51] Int. Cl.[5] ..... B22D 11/06

[52] U.S. Cl. ..... 164/423; 164/429; 164/463; 164/479

[58] Field of Search ..... 164/423, 429, 463, 479

[56] References Cited

U.S. PATENT DOCUMENTS

| | | | |
|---|---|---|---|
| 989,075 | 4/1911 | Staples | 164/423 |
| 1,017,943 | 2/1912 | Akin | 164/423 X |
| 1,063,895 | 6/1913 | Staples | 164/423 X |
| 4,281,706 | 8/1981 | Liebermann et al. | 164/463 |

FOREIGN PATENT DOCUMENTS

| | | | |
|---|---|---|---|
| 0039169 | 11/1981 | European Pat. Off. . | |
| 53-33526 | 9/1978 | Japan | 164/423 |
| 53-125228 | 11/1978 | Japan | 164/479 |
| 58-357 | 1/1983 | Japan . | |
| 60-21162 | 2/1985 | Japan | 164/423 |
| 60-83751 | 5/1985 | Japan | 164/429 |
| WO88/02288 | 4/1988 | PCT Int'l Appl. . | |
| 370976 | 7/1931 | United Kingdom . | |

OTHER PUBLICATIONS

Abstract of Japanese Patent Publication 59-209459 Published Nov. 28, 1984.

Abstract of Japanese Patent Publication 62-289355 Published Dec. 16, 1987.

Abstract of Japanese Patent Publication 60-83751 Published May 13, 1985.

*Primary Examiner*—J. Reed Batten, Jr.

*Attorney, Agent, or Firm*—Peter K. Kontler; Tobias Lewenstein

[57] ABSTRACT

Thin metal tapes are cast using a casting wheel (2) having a substantially vertical axis of rotation (3) and a metal supply line (4) comprising a casting nozzle (6) which has a metal discharge opening (7) directed towards a rotating cooling surface (8) of the casting wheel. The discharge opening (7) of the casting nozzle 6) is directed towards a substantially vertical drum surface (8) of the casting wheel (2) and a gap (A) of less than 1 mm is provided between the drum surface (8) and the metal discharge opening (7) of the casting nozzle (6).

14 Claims, 1 Drawing Sheet

Fig. 1
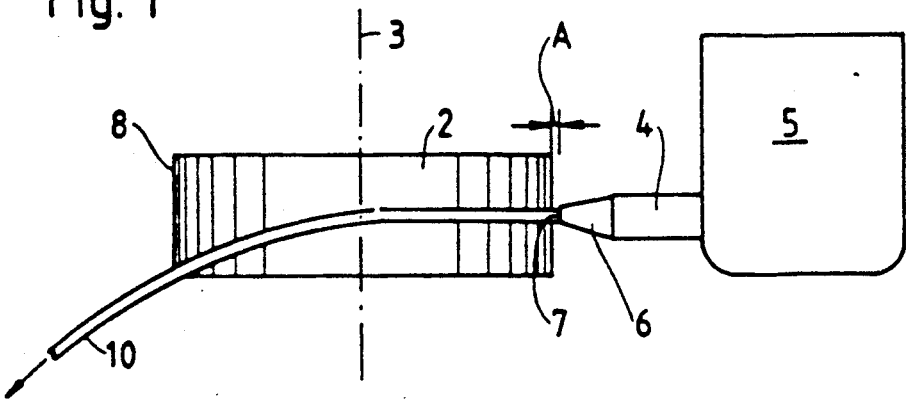
Fig. 2
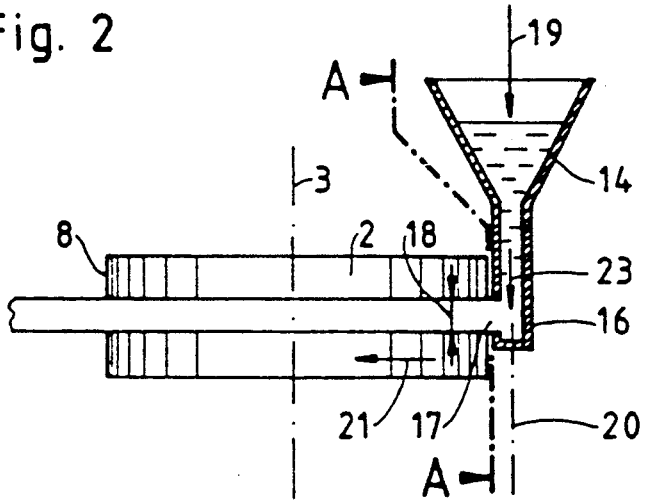
Fig. 2 A
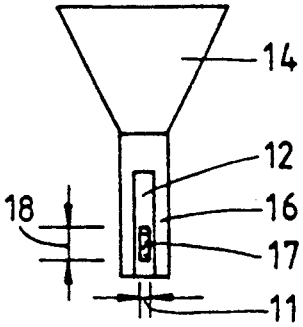
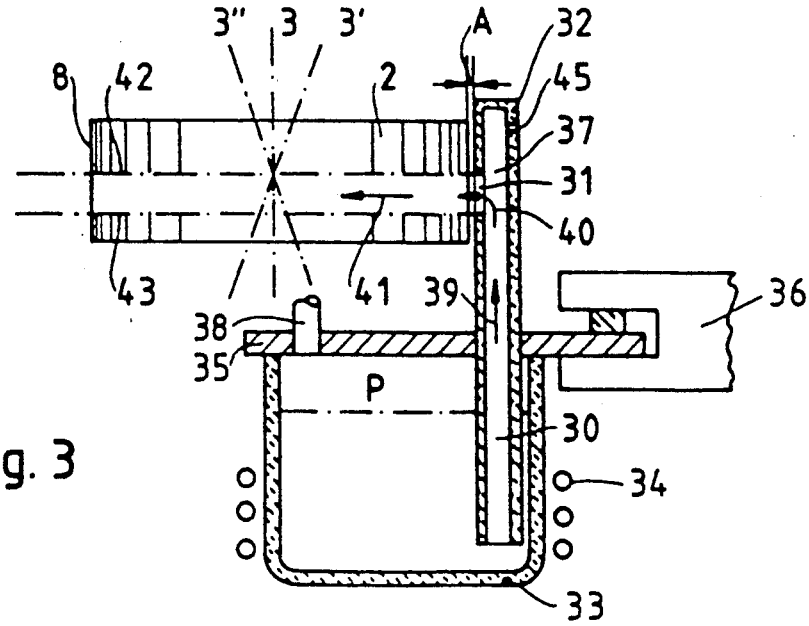
Fig. 3

APPARATUS FOR CASTING THIN TAPES

The invention relates to means for casting thin tapes of metal or metal oxide.

It is known to cast metal and metal-oxide melts, using casting wheels or on casting tapes. Crystalline or amorphous solidification can be obtained, depending on the alloy and rate of cooling of the melt. Tapes of this kind, having a width of less than 1 mm to 200 mm or more, can be used for a wide variety of purposes in chemistry, electrical engineering, etc. There are practically no limits to the materials, such as metal or metal oxide melts, which can be cast.

The use of casting wheels having a vertical axis of rotation is known from U.S. Pat. No. 4,281,706. A metal supply means is disposed above the wheel disc. The casting nozzle co-operating with the disc is disposed at a defined angle of inclination to the flat, horizontal disc surface or to slightly bevelled edge surfaces of the disc. The angle of incidence of the melt and the ratio of the speed of the glass jet to the speed of the rotating surface of the casting wheel is of special importance in this method of melt-spinning. Tapes made with this casting wheel are spiral and used for helical tape stacks. Straight tapes cannot be cast by this method.

It is also known from WO No. 88/02288 to casting wheels with a horizontal axis of rotation; instead of the melt-spinning process, the melt is drawn by the casting wheel out of a narrowly defined gap between the nozzle member and the casting-wheel surface. The casting nozzles used for this purpose can be provided with supply means from above or below the discharge opening of the casting nozzle. In both methods of supply, the flow to the nozzle has to be diverted in front of the casting nozzle in the melt supply system, which increases the cost of the nozzle and makes the method more subject to breakdown.

The object of the invention is a further improvement in the casting of tapes, with special regard to the method of supply metal to the casting wheel and an improved nozzle construction. According to the invention, this problem is solved by providing a vertically oriented, rotating cooling surface and directing the casting nozzle towards this surface in such a manner that a gap of less than 1 mm exists between the nozzle and the cooling surface.

The solution according to the invention can further improve the casting of tapes. The metal supply to the substantially vertical drum surface of the casting wheel provides new possibilities for designing metal supply systems and casting nozzles. More particularly the melt supply means can be substantially straight and either above or below the metal-discharge opening of the casting wheel. Another result is that the shape and nature of the melt container or of the metal supply means in the melt container can be freely varied. The casting nozzle can also be simplified, owing the co-operation between the drum surface and the casting wheel according to the invention. The result is that the casting process is more economic and more reliable.

The vertical drum surface of the casting wheel can be disposed either on the inside or the outside of a drum. According to an embodiment, the nozzle arrangement and the monitoring of the gap can be simplified if the metal discharge opening is directed towards a substantially cylindrical outer surface of the drum.

When the tapes produced are very narrow, the metal discharge opening of the casting nozzle can be made round or square. advantageously, in order to cast metal tapes having a width many times the thickness, the metal discharge opening of the casting nozzle is a slot and the slot length is disposed substantially parallel to the axis of rotation.

Additional advantages are obtainable if the casting nozzle is tubular and the longitudinal axis thereof is disposed substantially transversely to the direction of motion of the drum surface. Optionally the longitudinal axis of the metal outlet slot can be disposed in the tube surface, parallel to the longitudinal axis thereof.

Tubular refractory parts, more particularly tubes having a round cross-section, are obtainable as standard parts in various refractory grades. In order to produce tubular casting nozzles of the aforementioned kind cheaply, standardized tubular parts can be enclosed at one end of the tube and the other end can dip into a melt container. The casting nozzle can be completely separate from the melt container. A bore or slot can be used as a nozzle opening for discharging the metal on to the tube surface. If the melt has to be supplied from beneath the metal discharge opening of the nozzle, the tubular casting nozzle can be immersed in a pressure container, according to an additional embodiment.

If the casting nozzle has a tubular round cross-section, advantageously the outer tubular surface of the nozzle is flattened near the metal discharge opening, to obtain a given gap configuration.

The invention will now be explained in detail hereinafter, with reference to the drawings in which:

FIG. 1 is a diagrammatic view of a means for casting narrow tapes;

FIG. 2 is a diagrammatic view of another example of a casting means;

FIG. 2A is a view along the section line A—A of FIG. 2, and

FIG. 3 is a vertical section through another example of a casting means.

FIG. 1 shows a casting wheel 2 for casting thin tapes. The casting wheel 2 has a substantially vertical axis of rotation 3. A metal supply line 4 connects a metal storage container 5 to a casting nozzle 6 having a metal discharge opening 7 directed towards a rotating cooling surface of the casting wheel 2. The cooling surface is a substantially vertical drum surface 8, and a gap A less than 1 mm wide is provided between the metal discharge opening 7 and the drum surface 8.

The cylindrical outer drum surface 8 can have an axis of rotation inclined by a few degrees. Reference 10 denotes a metal tape coming away from the casting wheel 2.

In FIGS. 2 and 2A, a funnel-shaped metal supply means 14 is connected to a tubular casting nozzle 16. A metal discharge opening 17 in the form of a slot is directed towards the drum surface 8 of the casting wheel 2. Of course, either the entire casting means or the melt supply (indicated by an arrow 19) in the supply funnel 14 can be disposed in a vacuum casing or a protective gas atmosphere.

The length 18 of the metal discharge opening or slot 17 and the direction 23 in which metal is supplied to the casting nozzle 16, up to a short distance in front of the metal discharge opening 17, is substantially parallel to the axis of rotation 3. Also, a longitudinal axis 20 of the casting nozzle 16 is disposed transversely to the direction of rotation 21 of the drum surface 8. One width 11 of the discharge slot 17 is 5 to 50 times, preferably 10 to 30 times the set thickness of the tape to be cast. The tubular casting nozzle 16 is flattened on all sides around the metal discharge opening 17, so as to form a surface 12, which can be concave and coincide with the radius of the casting wheel 2.

In FIG. 3, axes of rotation 3' and 3'' are slightly inclined relative to the vertical axis of rotation 3. The casting wheel is substantially cylindrical. A round, tubular metal supply means 30 is formed as a casting nozzle at one end and has a slot 31 constituting a metal discharge opening. Above slot 31, the pipe end is closed by a cover 32. A vent 45 is provided for rapid venting before casting begins. The supply means is a vessel 33 heatable by heating elements 34. A suitably designed cover 35 seals vessel 33 in pressure-tight manner. In the present embodiment, cover 35 serves as a suspension for the metal supply line 30, the casting nozzle 37 and the vessel 33 on a holder 36. The holding device 36 is disposed very near the metal discharge opening 31 of the casting nozzle 37, so that the gap width A can be exactly maintained. It can be 0.05 to 0.5 mm, preferably 0.1 to 0.3 mm. Near the gap A, in the case of round casting nozzles 37, the nozzle surface is flattened on both sides of the metal outlet opening 31 or slot.

The supply line 30 and casting nozzle 37 can be immersed in the melt container 33 a short time before pouring begins, and can also be suspended separately from the melt container 33. In order to begin the casting process, a gas supply 38 generates a pressure above the metal bath, and drives it up into the casting nozzle 37. During casting, the metal container 33 can be continuously supplied with melt through a metal supply pipe (not shown).

During the casting process, the melt is driven up the tubular nozzle 37 in the direction of arrow 39 by a pressure P, and shortly before the nozzle opening 31 the melt is diverted by about 90° as per arrow 40. In the gap A between the discharge opening 31 and the drum surface 8, the inflowing melt is separated from the outflow direction in the discharge opening 31 and is again guided in the tape draw-off direction 41. Unexpectedly, as a result of rapid solidification on the drum surface 89, no melt falls into the defined gap A. Also, the tape is of the same quality and thickness at the top and bottom edges 42 and 43.

The gap A is usually made parallel in the case of narrow tapes. Alternatively the gap A can be made non-uniform in order to manufacture wider tapes, more particularly in the case of vertical casting tubes supplied from beneath. The gap can e.g. widen upwards. Also, the width 11 (FIG. 2A) of the metal discharge opening or slot can be made non-uniform along its length 18 (FIG. 2A) in order to control variations in the thickness of the tape or to improve the construction of edges.

I claim:

1. An apparatus for casting thin metal tapes comprising a casting wheel having a substantially vertical axis of rotation and a metal supply line comprising a casting nozzle which has a metal discharge opening directed towards a rotating cooling surface of said casting wheel, wherein said rotating cooling surface is substantially vertical and a gap of less than 1 mm is provided between said rotating cooling surface and said metal discharge opening of said casting nozzle, said rotating cooling surface comprising a substantially cylindrical outer surface of said casting wheel.

2. An apparatus according to claim 1, wherein said gap is 0.05–0.5 mm wide.

3. An apparatus according to claim 2, wherein said gap is 0.1–0.3 mm wide.

4. An apparatus according to claim 1, wherein said metal discharge opening of said casting nozzle is a slot.

5. An apparatus according to claim 4, wherein the direction of metal supply in said casting nozzle is substantially parallel to said axis of rotation.

6. An apparatus according to claim 4, wherein the longitudinal axis of said melt discharge opening or slot is disposed transversely to the direction of motion of said rotating cooling surface.

7. An apparatus according to claim 4, wherein the width of said metal discharge opening or slot is 5 to 50 times the set thickness of the tape to be cast.

8. The apparatus of claim 7, wherein the width of said metal discharge opening or slot is 10 to 30 times the set thickness of the tape to be cast.

9. An apparatus according to claim 1, wherein said casting nozzle is tubular and the longitudinal axis thereof is disposed substantially transversely to the direction of motion of said rotating cooling surface.

10. An apparatus according to claim 9, wherein said tubular casting nozzle has a closure and a vent at one end and the other end is connected to a liquid-metal supply means.

11. An apparatus according to claim 9, wherein said tubular casting nozzle has a round cross section.

12. An apparatus according to claim 9, wherein the outer tubular surface of said casting nozzle is flattened around said metal discharge opening.

13. An apparatus according to claim 9, further comprising a melt container; and wherein said tubular casting nozzle is separate from said melt container.

14. An apparatus according to claim 9, wherein said tubular casting nozzle dips into a storage vessel in the form of a pressure container.

* * * * *